United States Patent [19]

Koyama et al.

[11] Patent Number: 4,585,324

[45] Date of Patent: Apr. 29, 1986

[54] SHELL-TYPE ELECTROSTATIC COPYING APPARATUS

[75] Inventors: Shigeo Koyama, Ibaraki; Nobuhiko Kozuka, Suita; Atsushi Kano, Amagasaki, all of Japan

[73] Assignee: Mita Industrial Co., Ltd., Osaka, Japan

[21] Appl. No.: 596,991

[22] Filed: Apr. 5, 1984

[30] Foreign Application Priority Data

Apr. 11, 1983 [JP] Japan ..... 58-62125

[51] Int. Cl.[4] ..... G03G 15/00

[52] U.S. Cl. ..... 355/3 R; 355/3 DR

[58] Field of Search ..... 355/3 R, 3 DR, 3 SH, 355/133

[56] References Cited

U.S. PATENT DOCUMENTS 3,997,262 12/1976 Doi et al. ..... 355/11

4,335,950 6/1982 Gunzelmann et al. ..... 355/3 R 4,412,734 11/1983 Shibuya et al. ..... 355/3 R X

*Primary Examiner*—Arthur T. Grimley

*Assistant Examiner*—J. Pendegrass

*Attorney, Agent, or Firm*—Beveridge, DeGrandi & Weilacher

[57] ABSTRACT

A shell-type electrostatic copying apparatus comprising a supporting structure comprised of a lower supporting frame and an upper supporting frame pivotally mounted on the lower supporting frame, a rotating drum rotatably mounted on the supporting structure, a copying paper feed device and a copying paper conveying mechanism including a plurality of lower elements and a plurality of upper elements for conducting a copying paper delivered from the paper feed device to the rotating drum. A conveying unit frame is pivotably mounted on the supporting structure. At least one of the upper elements is mounted on the conveying unit frame, and at least one of the lower elements, on the lower supporting frame. The apparatus also includes a drum unit frame having the rotating drum rotatably mounted thereon. A provisional unit placing means for supporting the drum unit frame movably is provided in the lower supporting frame and/or the conveying unit frame. The drum unit including the drum unit frame is provisionally placed on the provisional unit placing means, and then in the required manner, mounted detachably on the upper supporting frame.

18 Claims, 7 Drawing Figures

SHELL-TYPE ELECTROSTATIC COPYING APPARATUS

FIELD OF THE INVENTION

This invention relates to an electrostatic copying apparatus, particularly to one called a shell-type.

DESCRIPTION OF THE PRIOR ART

As is well known to those skilled in the art, electrostatic copying apparatuses of the so-called shell type including an upper supporting frame and a lower supporting frame linked to each other for relative pivotal movement between an open position and a closed position (usually the lower supporting frame is fixed at a predetermined position and the upper supporting frame is mounted on the lower supporting frame for free pivotal movement between the open and closed positions) have been proposed and come into practical application. Generally, when the upper supporting frame of such a shell-type electrostatic copying apparatus is pivoted and held at the open position, at least a considerable portion of a conveying passage for a sheet material such as a copying paper is opened. Hence, if jamming of the sheet material should occur in the conveying passage, it can be easily taken out.

In this type of electrostatic copying apparatus, a rotating drum is mounted on the upper supporting frame that is pivotally mounted on the lower supporting frame. The rotating drum, however, is difficult to mount and detach sufficiently easily and rapidly, and in addition, a photosensitive material disposed on the peripheral surface of the rotating drum is likely to be subject to damage during the mounting and detaching operations (the damage may occur, for example, when the operator's hand touches the surface of the photosensitive material during the mounting and detaching operations, or the surface of the photosensitive member contacts part of the electrostatic copying apparatus).

An improved shell-type electrostatic copying apparatus which permits sufficiently easy and rapid mounting and detaching of the rotating drum has been proposed. This shell-type electrostatic copying apparatus is disclosed in the specification and drawings of Japanese Patent Application No. 26283/1983 (entitled: Shell-Type Electrostatic Copying Apparatus) filed on Feb. 21, 1983 (corresponding to copending U.S. patent application Ser. No. 577,916 filed on Feb. 7, 1984, and copending European Patent Application No. 84101789.0 filed on Feb. 21, 1984). With this improved electrostatic copying apparatus, the upper supporting frame is held at the open position to place a unit having the rotating drum mounted thereon on a provisional unit placing means provided at the lower supporting frame. Then, the upper supporting frame is held at the closed position and the unit is moved rearwardly in the front-rear direction. Thereafter, the movement of the unit with respect to the upper supporting frame is restained by a restraining means. As a result, the unit containing the rotating drum is mounted detachably on the supporting frame.

However, as can be seen from the specification and drawings (particularly FIG. 1) of the above-cited copending application, a copying paper conveying passage ranging from a paper feed device to the rotating drum in this shell-type electrostatic copying apparatus cannot be opened even when the upper supporting frame is held at the open position. Consequently, a copying paper cannot easily be taken out from the conveying passage in the event of jamming. It is still desired therefore to improve the apparatus in this respect.

SUMMARY OF THE INVENTION

It is an object of this invention therefore to provide a more improved shell-type electrostatic copying apparatus in which a copying paper conveying passage ranging from a paper feed device to a rotating drum can be opened by holding an upper supporting frame at an open position.

Another object of this invention is to provide a more improved shell-type electrostatic copying apparatus which can be conveniently applied to a type of apparatus in which a drum unit frame including a rotating drum is first placed on a provisional unit placing means and then mounted on an upper supporting frame.

According to one aspect of this invention, there is provided a shell-type electrostatic copying apparatus comprising a supporting structure consisting of a lower supporting frame and an upper supporting frame mounted on the lower supporting frame for free pivotal movement between an open position and a closed position about a pivoting axis extending in the front-rear direction as a center, a rotating drum mounted rotatably on the supporting structure, at least one copying paper feed device mounted on the supporting structure, and a copying paper conveying mechanism for conducting a copying paper delivered from the paper feed device to the rotating drum, said conveying mechanism including a plurality of lower elements and a plurality of upper elements with a copying paper conveying passage being defined between the lower elements and the upper elements; wherein at least one of the lower elements of the paper conveying mechanism is mounted on the lower supporting frame, a conveying unit frame is mounted on the supporting structure for free pivotal movement about a pivoting axis extending in the front-rear direction, a restraining means is provided for releasably restraining the conveying unit frame at a predetermined position with respect to the upper supporting frame, and at least one of the upper elements of the conveying mechanism is mounted on the conveying unit frame.

According to another aspect of this invention, there is provided a shell-type electrostatic copying apparatus comprising a supporting structure consisting of a lower supporting frame and an upper supporting frame having a vertical front base plate and a vertical rear base plate spaced from each other in the front-rear direction, said upper supporting frame being mounted on the lower supporting frame for free pivotal movement between an open position and a closed position about a pivoting axis extending in the front-rear direction, a drum unit adapted to be detachably mounted on the upper supporting frame, said drum unit including a drum unit frame having a front wall and a rear wall spaced from each other in the front-rear direction and a rotating drum rotatably mounted on the drum unit frame, at least one copying paper feed device mounted on the supporting structure, and a copying paper conveying mechanism for conducting a copying paper delivered from the paper feed device to the rotating drum, said conveying mechanism including a plurality of lower elements and a plurality of upper elements with a copying paper conveying passage being defined between the lower elements and the upper elements; wherein at least one of the lower elements of the paper conveying mechanism is mounted on the lower supporting frame;

a conveying unit frame is mounted on the supporting structure for free pivotal movement about a pivoting axis extending in the front-rear direction;

at least one of the upper elements of the paper conveying mechanism is mounted on the conveying unit frame;

a provisional unit placing means for supporting the drum unit frame of the drum unit movably over a predetermined range in the front-rear direction is provided in the lower supporting frame and/or the conveying unit frame;

at least two laterally spaced engaging openings are formed in one of the front wall of the drum unit frame and the vertical front base plate of the upper supporting frame and at least two laterally spaced engaging projections are formed in the other, and at least two laterally spaced engaging projections are formed in one of the rear wall of the drum unit frame and the vertical rear base plate of the upper supporting frame and at least two laterally spaced engaging openings are formed in the other;

a restraining means is provided for releasably restraining the movement of the drum unit with respect to the upper supporting frame in the front-rear direction and also releasably restraining the conveying unit frame at a predetermined position with respect to the upper supporting frame; and when the conveying unit frame is set at an operating position at which at least one of the upper elements mounted thereon is in a predetermined operative relation to at least one of the lower elements mounted on the lower supporting frame, then the drum unit frame is provisionally placed at a predetermined position on the provisional placing means, and thereafter the upper supporting frame is pivoted from the open position to the closed position, the engaging openings formed in one of the front wall of the drum unit frame and the vertical front base plate of the upper supporting frame are brought into alignment in the front-rear direction with the engaging projections formed in the other and at the same time, the engaging projections formed in one of the rear wall of the drum unit frame and the vertical rear base plate of the upper supporting frame are brought into alignment in the front-rear direction with the engaging openings formed in the other; thereafter, when the drum unit frame is set at a mounting position by moving it rearwardly or frontwardly from the provisional placing position, the engaging openings formed in one of the front wall of the drum unit frame and the vertical front base plate of the upper supporting frame engage the engaging projections formed in the other and at the same time, the engaging projections formed in one of the rear wall of the drum unit frame and the vertical rear base plate of the upper supporting frame engage the engaging openings formed in the other; and thereafter, when the movement in the front-rear direction of the drum unit frame with respect to the upper supporting frame is releasably restrained by the restraining means and the conveying unit frame is releasably restrained by the restraining means at the predetermined position with respect to the upper supporting frame, the drum unit and the conveying unit frame are mounted on the upper supporting frame so that they move as a unit with the upper supporting frame.

Other objects and advantages of this invention will become apparent from the following description.

DETAILED DESCRIPTION OF PREFERRED EMBODIMENTS

Figure 1:
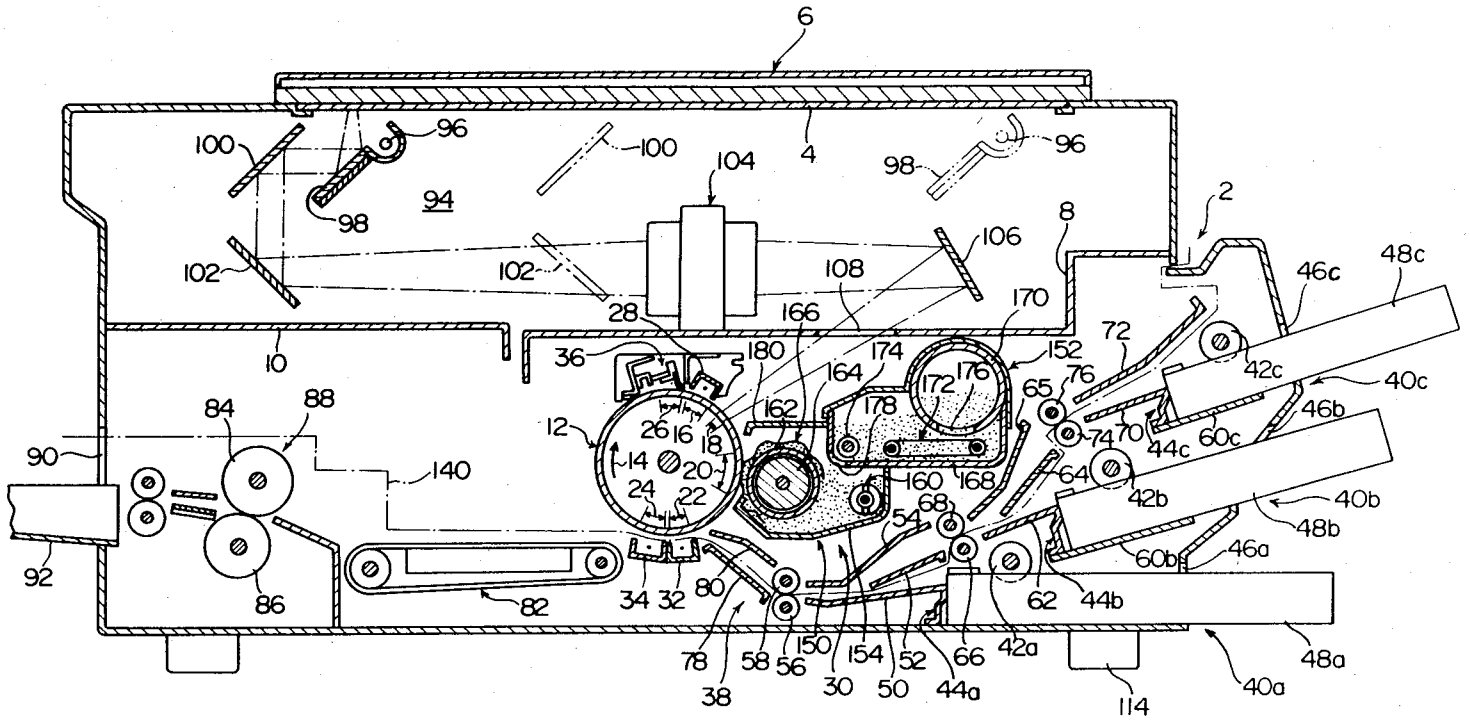
FIG. 1 is a simplified sectional view showing the general structure of the shell-type electrostatic copying apparatus constructed in accordance with this invention.

Preferred embodiments of the shell-type electrostatic copying apparatus constructed in accordance with this invention are described in detail with reference to the drawings.

First, with reference to FIG. 1, the structure of the electrostatic copying apparatus of this invention as a whole will be described.

The illustrated electrostatic copying apparatus has a housing shown generally at 2. A transparent plate 4 on which to place a document to be copied is disposed on the upper surface of the housing 2. Also provided on the upper surface of the housing 2 is a document holder 6 which is openable or closable for covering the transparent plate 4 and the document thereon (in FIG. 1, the document holder 6 is shown in its closed position covering the transparent plate 4).

The inside of the housing 2 is divided into an upper space and a lower space by horizontal plates 8 and 10. A rotating drum 12 having a photosensitive member on its peripheral surface is rotatably mounted nearly centrally in the lower space. Around the rotating drum 12 to be rotated in the direction of an arrow 14, there are provided a charging zone 16, an exposing zone 18, a developing zone 20, a transferring zone 22, a peeling zone 24 and a cleaning zone 26 in this sequence in the drum rotating direction. A charging corona discharge device 28 is disposed in the charging zone 16. A suitable developing device 30 is disposed in the developing zone. A transferring corona discharge device 32 is disposed in the transferring zone 22. A peeling corona discharge device 34 is disposed in the peeling zone 24. In the cleaning zone 26, a cleaning device 36 is provided.

A copying paper conveying means shown generally at 38 is disposed in the lower portion of the lower space of the housing 2. A copying paper feed means is provided at one end portion, i.e. the right end portion in FIG. 1, of the paper conveying means 38. In the illustrated embodiments, the copying paper feed means is comprised of a first paper feed device 40*a*, a second paper feed device 40*b* and a third paper feed device 40*c* all of which are of the cassette type. The first paper feed device 40*a* consists of a cassette-receiving section 44*a* (partly defined by the bottom wall of the housing) having a feed roller 42*a* provided therein and a copying paper cassette 48*a* to be loaded into the cassette-receiving section 44*a* through an opening 46*a* formed in the right wall of the housing 2, and by the action of the feed roller 42*a*, feeds copying papers one by one from a stack of sheet-like copying papers (not shown) accommodated in the cassette 48*a*. The copying paper delivered from the cassette 48*a* passes between guide plates 50 and 52 and between guide plates 50 and 54 and fed between a pair of conveying rollers 56 and 58.

The second feed device 40*b* consists of a cassette-receiving section 44*b* (partly defined by a cassette-receiving member 60*b*) having a feed roller 42*b* provided therein and a copying paper cassette 48*b* to be loaded into the cassette-receiving section 44*b* through an opening 46*b* formed in the right wall of the housing 2, and by the action of the feed roller 42*b*, feeds copying papers one by one from a stack of sheet-like copying papers (not shown) accommodated in the paper cassette 48*b*. The copying paper delivered from the cassette 48*b* passes between guide plates 62 and 64 and between guide plates 62 and 65 and is fed between a pair of conveying rollers 66 and 68. Thereafter, by the action of the conveying rollers 66 and 68, passes between the guide plates 52 and 54 and between the guide plates 50 and 54 and is fed between the conveying rollers 56 and 58.

The third paper feed device 40*c* consists of a cassette-receiving section 44*c* (partly defined by a cassette-receiving member 60*c*) having a feed roller 42*c* provided therein and a copying paper cassette 48*c* to be loaded into the cassette-receiving section 44*c* through an opening 46*c* formed in the right wall of the housing 2, and by the action of the feed roller 42*c*, feeds copying papers one by one from a stack of sheet-like copying papers (not shown) accommodated in the cassette 48*c*. The copying paper delivered from the cassette 48*c* passes between guide plates 70 and 72 and is fed between a pair of conveying rollers 74 and 76. Subsequently, by the action of the conveying rollers 74 and 76, it passes between guide plates 64 and 65 and between guide plates 62 and 65 and is fed between the pair of conveying rollers 66 and 68. Thereafter, it is fed between the conveying rollers 56 and 58 by the action of the conveying rollers 66 and 68. In the present embodiment, the paper cassette 48*a* contains papers having a size of JIS B4; the paper cassette 48*b*, papers having a size of JIS A4 and the cassette 48*c*, papers having a size of JIS B5.

The copying paper which has been fed into between the conveying rollers 56 and 58 from the first paper feed device 40*a* (or the second paper feed device 40*b* or the third paper feed device 40*c*) in the manner described above is then conveyed to the transferring zone 22 and the peeling zone 24 via the space between guide plates 78 and 80 by the action of the conveying rollers 56 and 58. It is further conveyed by the action of a suitable conveyor belt mechanism 82 and fed into a heat fixing device 88 comprised of a heated roller 84 having a heater (not shown) disposed therein and a pressing roller 86 kept in press contact with the heated roller 84. Finally, the copying paper is discharged onto a receiving tray 92 through an opening 90 formed in the left wall of the housing 2.

An optical unit shown generally at 94 is provided in the upper space above the horizontal plates 8 and 10 within the housing 2 for scanning and exposing a document placed on the transparent plate 4 and projecting the image of the document onto the photosensitive member on the rotating drum 12 in the exposing zone 18. The optical unit 94 has a document illuminating lamp 96 for illuminating the document on the transparent plate 4, and a first reflecting mirror 98, a second reflecting mirror 100, a third reflecting mirror 102, a lens assembly 104 and a fourth reflecting mirror 106 for projecting the light reflected from the document onto the photosensitive member. During scanning and exposure, the document illuminating lamp 96 and the first relfecting mirror 98 are moved at a given speed V substantially horizontally from a scan-exposure starting position shown by a solid line to a given position (for example, a maximum scan-exposure end position shown by a two-dot chain line), and the second reflecting mirror 100 and the third reflecting mirror 102 are moved at a speed (V/2) one-half of the above given speed V from a scan-exposure starting position shown by a solid line to a given position (for example, a maximum scan-exposure end position shown by a two-dot chain line). In the meantime, the reflected light from the document illuminated by the illuminating lamp 96 is reflected successively by the first, second and third reflecting mirrors 98, 100 and 102 and reaches the lens assembly 104. Then, it is reflected by the fourth relfecting mirror 106 and reaches the photosensitive member in the exposing zone 18 via an opening 108 formed in the horiziontal plate 8. When the scan-exposure is over, the document illuminating lamp 96 and the first, second and third reflecting mirrors 98, 100 and 102 are returned to the scan-exposure start position shown by the solid line.

In the copying apparatus described above, while the rotating drum 12 is rotated in the direction of arrow 14, the charging corona discharge device 28 charges the photosensitive member substantially uniformly to a specified polarity in the charging zone 16, and then in the exposing zone 18, the optical unit 94 projects the image of the document onto the photosensitive member to form thereon a latent electrostatic image corresponding to the document. Then, in the developing zone 20, a toner is applied to the latent electrostatic image on the photosensitive member by the developing device 30 to develop it to a toner image. In the transferring zone 22, a sheet material such as a copying paper sheet fed from the paper feed means (the first paper feed device 40*a*, the second paper feed device 40*b* or the third paper feed device 40*c*) is brought into contact with the photosensitive member. As a result, the toner image is transferred from the photosensitive member to the sheet material by the action of the transferring corona discharge device 32. The sheet material is then peeled off from the photosensitive member in the peeling zone 24 by the action of the peeling corona discharge device 34. The sheet material having the toner image transferred thereto is then conveyed to the fixing device 88 to fix the toner image under heat, and finally discharged onto the receiving tray 92. In the meanwhile, the rotating drum 12 continues to rotate and in the cleaning zone 26, the toner and the electrostatic charge remaining on the photosensitive member after the transfer are removed by the action of the cleaning device 36.

Figure 2:
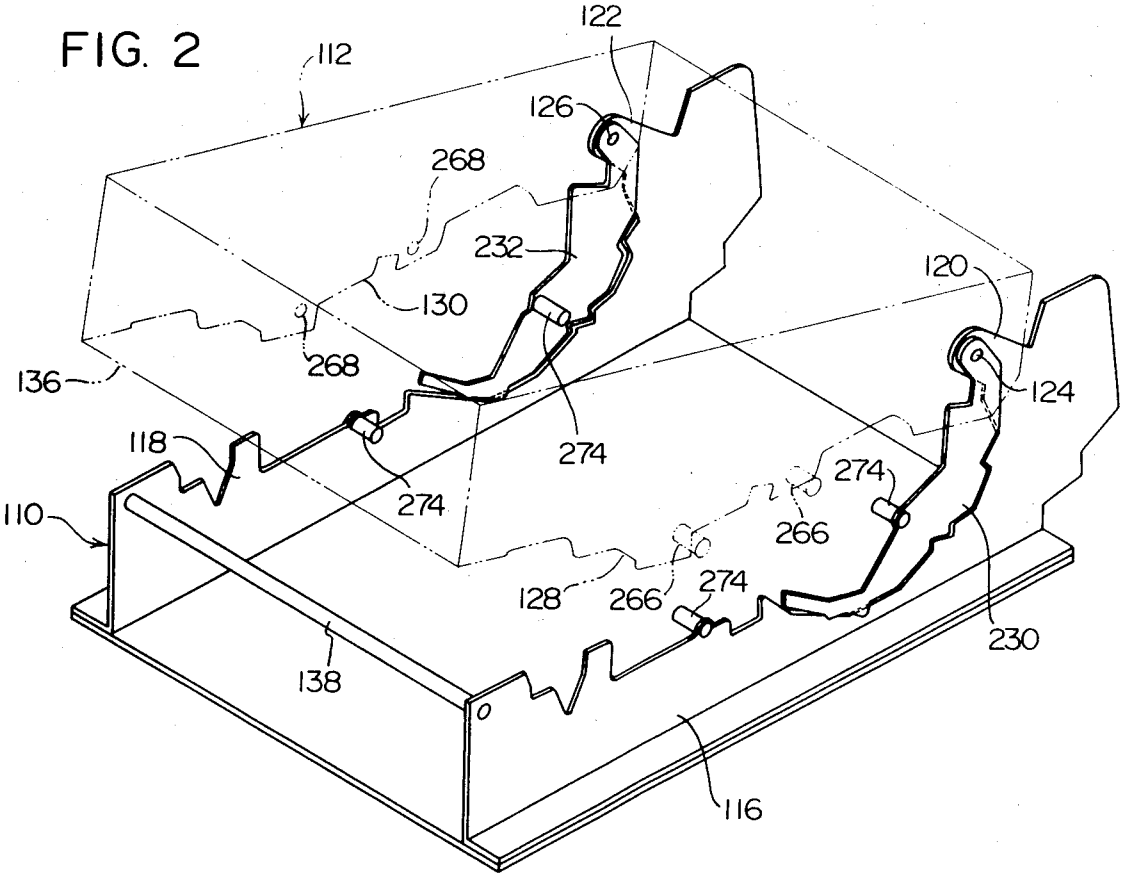
FIG. 2 is a simplified perspective view showing a shell-type supporting structure in the electrostatic copying apparatus shown in FIG. 1.

The electrostatic copying apparatus illustrated in FIG. 1 has a so-called shell-type supporting structure comprised of a lower supporting frame 110 and an upper supporting frame 112 (shown by a two-dot chain line in FIG. 2) pivotably mounted on the lower supporting frame 110 as shown in FIG. 2.

Figure 7:
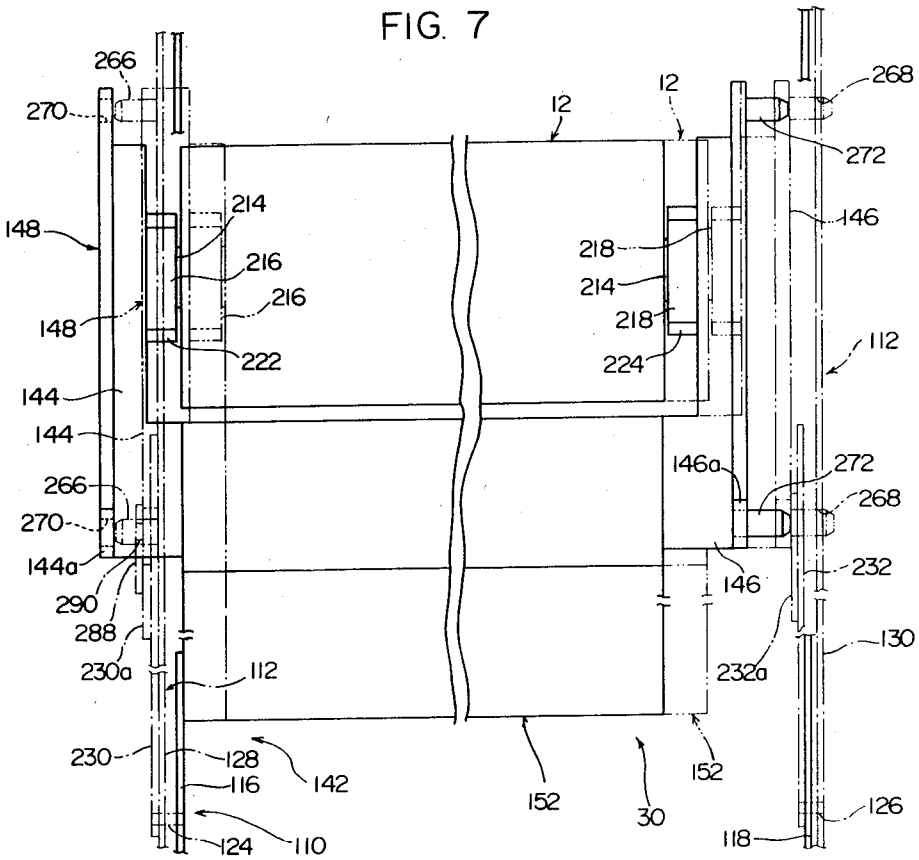
FIG. 7 is a partly omitted view showing the positioning of a drum unit frame in the electrostatic copying apparatus of FIG. 1 at a provisional placing position and a mounting position.

With reference to FIG. 2, a supporting leg 114 (FIG. 1) is provided on the lower surface of the lower supporting frame 110. By positioning the supporting leg 114 on the upper surface of a supporting table (not shown) for example, the lower supporting frame 110 is placed at a given position. The lower supporting frame 110 has a vertical front base plate 116 and a vertical rear base plate 118 which are spaced from each other by a predetermined distance in the front-rear direction (i.e., the direction perpendicular to the sheet surface in FIGS. 1 and 3, the direction extending from right bottom toward left top in FIG. 2, and the left-right direction in FIG. 7). Upwardly projecting supporting projections 120 and 122 are formed respectively at the right end portions of the vertical front base plate 116 and the vertical rear base plate 118 of the lower supporting frame 110. Supporting pins 124 and 126 are fixed respectively to the supporting projections 120 and 122. As shown in FIG. 7, the supporting pin 124 fixed to the vertical front base plate 116 projects slightly frontwardly from the front surface of the vertical front base plate 116, and the supporting pin 126 fixed to the vertical rear base plate 118 projects slightly frontwardly from the front surface of the vertical rear base plate 118 and slightly rearwardly from the rear surface of the vertical rear base plate 118.

Figure 3:
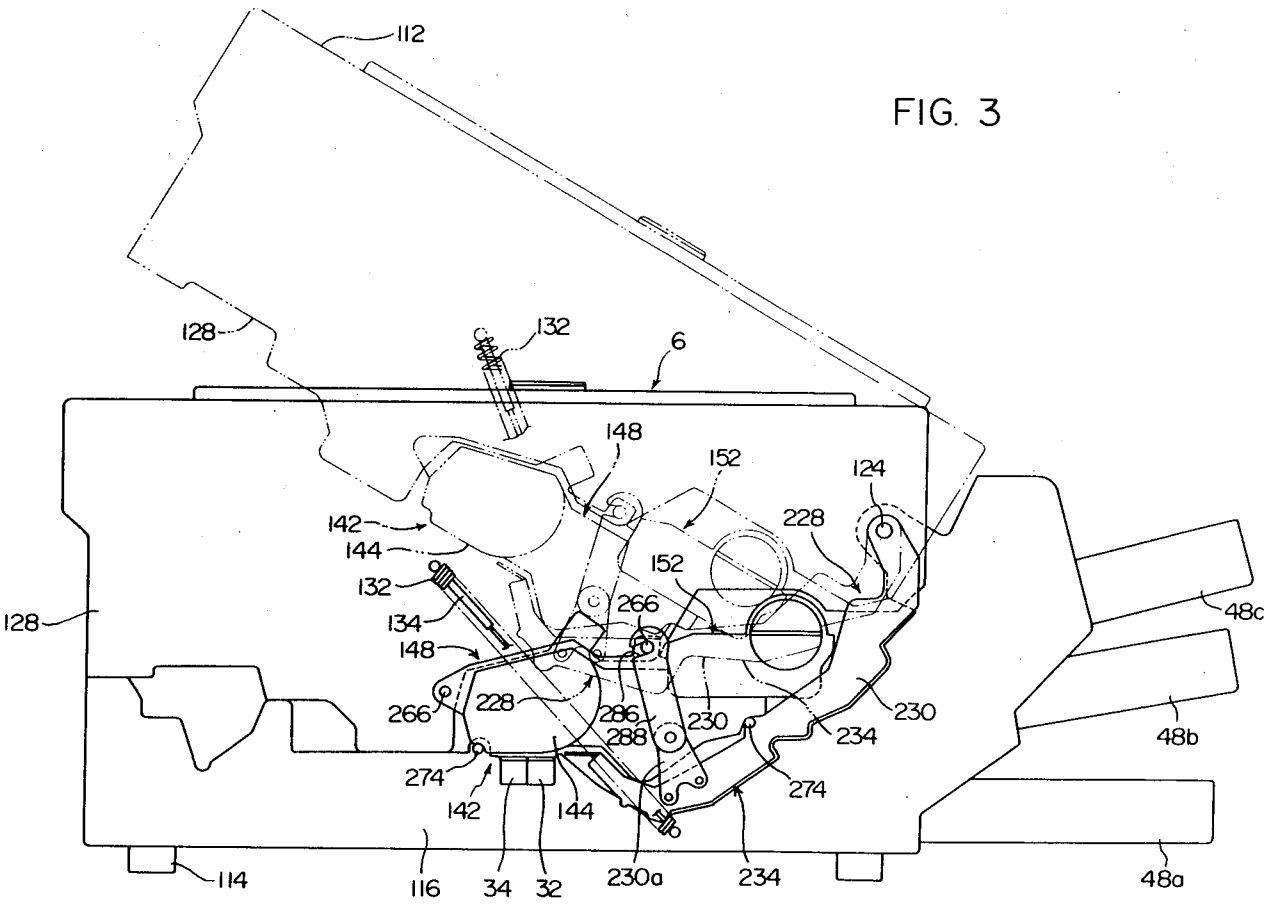
FIG. 3 shows the positioning of an upper supporting frame in the electrostatic copying apparatus of FIG. 1 at a closed position and an open position.

The upper supporting frame 112 also has a vertical front base plate 128 and a vertical rear base plate 130 spaced from each other at a predetermined distance in the front-rear direction (i.e., the direction perpendicular to the sheet surface in FIGS. 1 and 3, the direction extending from right bottom toward left top in FIG. 2, and in the left-right direction in FIG. 7). The distance between the vertical front base plate 128 and the vertical rear base plate 130 of the upper supporting frame 112 in the front-rear direction is slightly larger than the distance between the vertical front base plate 116 and the vertical rear base plate 118 of the lower supporting frame 110 in the front-rear direction. The vertical front base plate 128 and the vertical rear base plate 130 of the upper supporting frame 112 are located slightly frontwardly and rearwardly of the vertical front base plate 116 and the vertical rear base plate 118 of the lower supporting frame 110 (see FIG. 7 also). Holes are formed respectively in the right end portions of the vertical front base plate 128 and the vertical rear base plate 130 of the upper supporting frame 112. The hole formed in the vertical front base plate 128 receives the frontwardly projecting end portion of the supporting pin 124 fixed to the vertical front base plate 116 of the lower supporting frame 110, and the hole formed in the vertical rear base plate 130 receives the rearwardly projecting end portion of the supporting pin 126 fixed to the vertical rear base plate 118 of the lower supporting frame 110. As a result, the upper supporting frame 112 is mounted on the lower supporting frame 110 so that it can freely pivot about the central axis of the supporting pins 124 and 126 (this central axis becomes the pivoting axis of the upper supporting frame 112 extending in the front-rear direction).

Between the lower supporting frame 110 and the upper supporting frame 112 pivotably mounted on it is interposed a spring means for elastically biasing the upper supporting frame 112 clockwise in FIGS. 1 to 3 (more specifically, in FIG. 2, clockwise as viewed from right bottom toward left top) about the supporting pins 124 and 126 as a center with respect to the lower supporting frame 110. The spring means is comprised of a pair of compression coil springs 132 (only one of which is shown in FIG. 3). One end of one of the compression coil springs 132 is mounted on the front surface of the vertical front base plate 116 of the lower supporting frame 110, and the other end, on the front surface of the vertical front base plate 128 of the upper supporting frame 112, as shown in FIG. 3. Furthermore, although not shown in the drawings, one end of the other compression spring 132 is mounted on the rear surface of the vertical rear base plate 118 of the lower supporting frame 110 and the other end, on the rear surface of the vertical rear base plate 130 of the upper supporting frame 112. A stretchable rod-like member 134 is disposed within each of the compression coil spring 132 (only one member 134 is shown in FIG. 3). As shown in FIG. 3, one end of one rod-like member 134 is mounted pivotably on the front surface of the vertical front base plate 116 of the lower supporting frame 110, and the other end is mounted pivotably on the front surface of the vertical front base plate of the upper supporting frame 112. Furthermore, although not shown in the drawings, one end of the other rod-like member 134 is mounted pivotably on the rear surface of the vertical rear base plate 118 of the lower supporting frame 110, and the other end, on the rear surface of the vertical rear base plate 130 of the upper supporting frame 112. The compression coil springs 132 described above bias the upper supporting frame 112 clockwise in FIGS. 2 and 3 about the supporting pins 124 and 126 as a center. As will be readily understood, when the upper supporting frame 112 is pivoted clockwise in FIGS. 2 and 3 by the elastic biasing action of the compression coil springs 132, the elastic biasing force of the compression springs 132 becomes gradually smaller as the upper supporting frame 112 is pivoted. When the upper supporting frame 112 is pivoted to an open position shown in FIG. 2 (by a two-dot chain line) and a two-dot chain line in FIG. 3, the elastic biasing force of the compression coil springs 132 tending to pivot the upper supporting frame 112 clockwise in FIGS. 2 and 3 about the supporting pins 124 and 126 as a center comes into equilibrium with the force of moment tending to pivot the upper supporting frame 112 counterclockwise (more specifically, in FIG. 2, counterclockwise as viewed from right bottom toward left top) about the supporting pins 124 and 126 as a center owing to the weight of the upper supporting frame 112 and the various constituent elements mounted on it. Consequently, the upper supporting frame 112 is held at the open position shown in FIG. 2 and by the two-dot chain line in FIG. 3.

At the lower end portion of a vertical left base plate 136 of the upper supporting frame 112 is provided a locking menas (not shown) of any desired type known per se for locking the upper supporting frame 112 at a closed position shown by a solid line in FIG. 3 against the elastic biasing action of the compression coil springs 132 (when the upper supporting frame 112 is held at the closed position, the various constituent elements mounted on the lower supporting frame 110 and the various constituent elements mounted on the upper supporting frame 112 are held at the positions shown in FIG. 1 and the apparatus becomes ready for copying operation). The locking means is adapted to come into and out of engagement with an engaging shaft 138 (FIG. 2) mounted across the upper left end portions of the vertical front base plate 116 and the vertical rear base plate 118 of the lower supporting frame 110, and holds the upper supporting frame 112 at the closed position shown by the solid line in FIG. 3 when a part of the locking means comes into engagement with the engaging shaft 138.

With reference to FIGS. 1 to 3, in the illustrated electrostatic copying apparatus, constituent elements located below the one-dot chain line 140 in FIG. 1 (for example, the copying paper feed means, most of the paper conveying means 38, the transferring corona discharge device 32, and the peeling corona discharge device 34) are mounted on the lower supporting frame 110, and constituent elements located above the one-dot chain line 140 in FIG. 1 (for example, the rotating drum 12, the charging corona discharge device 28, the developing device 30, the cleaning device 36, the optical unit 94 and a part of the copying paper conveying means 38) are mounted on the upper supporting frame 112. It will be readily understood therefore with reference to FIG. 1 that most of the paper conveying passage is left open when the upper supporting frame 112 is held at the open position.

In the aforesaid electrostatic copying apparatus, the rotating drum 12 and the developing device 30 are constructed as a unit in order to mount and detach them easily and rapidly for repair, inspection, cleaning, replacing, or otherwise. This unit is detachably mounted on the upper supporting frame 112. Furthermore, a part of the copying paper conveying means 38 is constructed as a unit in order to open a paper conveying passage ranging from the paper feed means (the first paper feed device 40*a*, the second paper feed device 40*b* or the third paper feed device 40*c*) to the rotating drum 12. This umit is pivotably mounted on the supporting structure comprised of the lower supporting frame 110 and the upper supporting frame 112.

Figure 4:
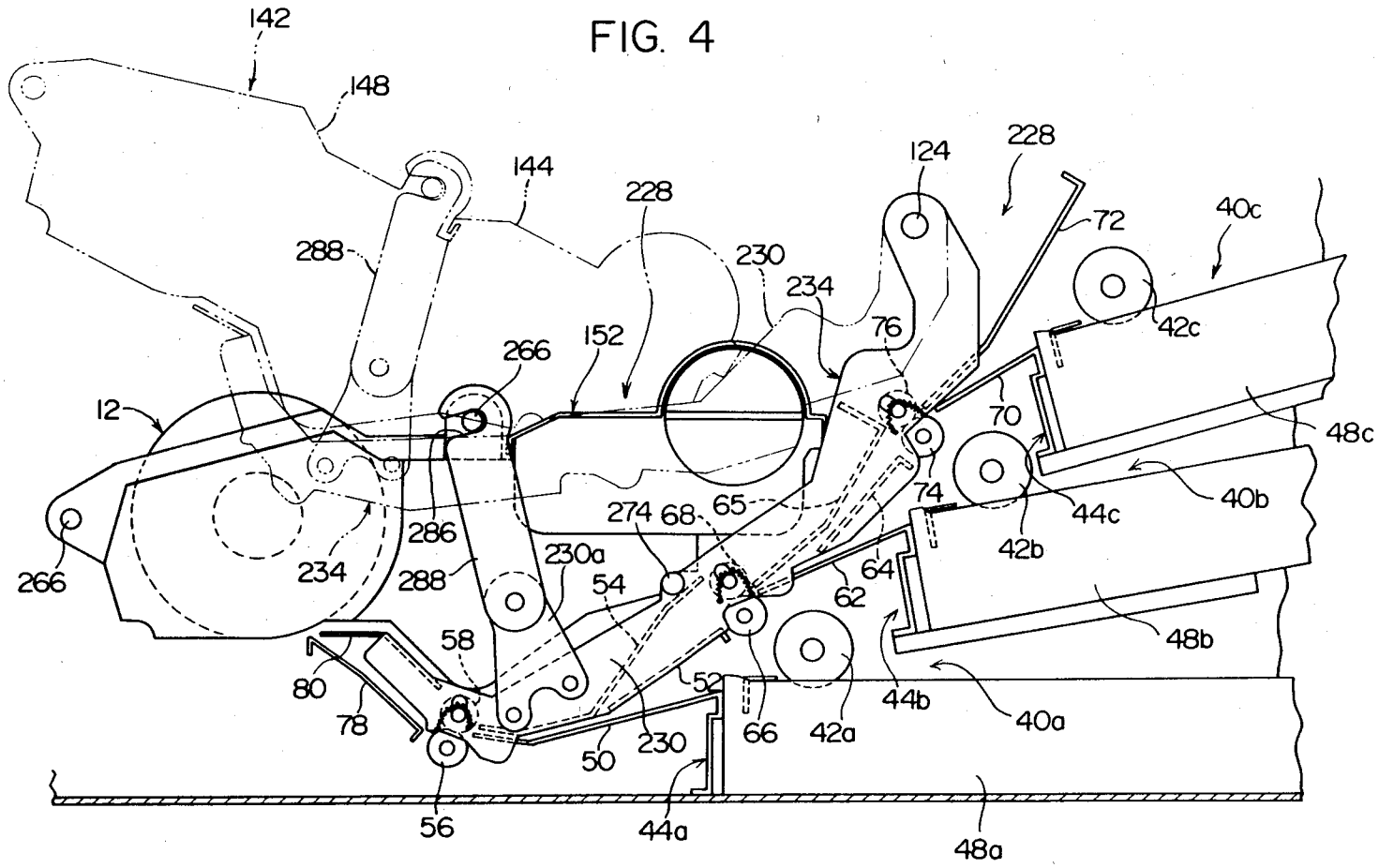
FIG. 4 shows a copying paper conveying passage ranging from a copying paper feed means to a rotating drum and its vicinity in the electrostatic copying apparatus shown in FIG. 1.
Figure 5:
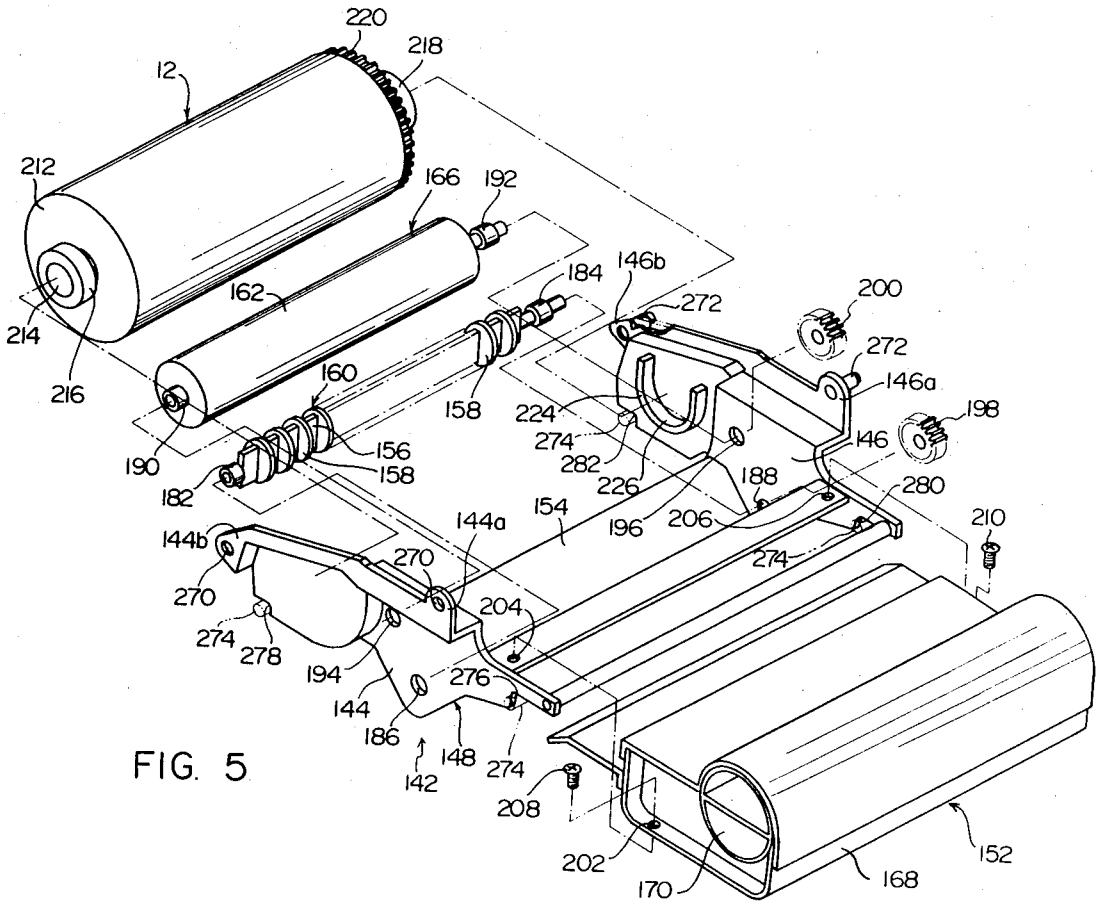
FIG. 5 is an exploded perspective view showing a drum unit in the electrostatic copying apparatus shown in FIG. 1.

With reference to FIGS. 1 and 3 to 5, mainly FIGS. 4 and 5, the drum unit including the rotating drum 12 and the developing device 30 will be described. The drum unit shown generally at 142 includes a drum unit frame 148 having a front wall 144 and a rear wall 146 spaced from each other in the front-rear direction (the direction perpendicular to the sheet surface in FIGS. 3 and 4, the direction extending from left bottom toward right top in FIG. 5, and the left-right direction in FIG. 7), and the rotating drum 12 and the developing device 30 are mounted on the drum unit frame 148.

First, with reference to FIGS. 5 and 1, the developing device 30 which may be of a known type will be described. The illustrated developing device 30 is comprised of a developing mechanism 150 and a toner supply mechanism 152. The developing mechanism 150 is comprised of a developer receptacle 154 for holding a developer composed of a toner and carrier, a stirring means 160 having a stirring plate 156 and a plurality of nearly semi-circular stirring vanes 158 disposed on both surfaces of the stirring plate 156, and a magnetic brush means 166 having a cylindrical sleeve 162 and a roll-like stationary permanent magnet 164 (FIG. 1) disposed within the sleeve 162. The stirring means 160 is rotated counterclockwise in FIG. 1 and stirs up the developer in the developer receptacle 154 thereby triboelectrically charging the toner. The sleeve 162 of the magnetic brush means 166 is rotated clockwise in FIG. 1. The sleeve 162 holds the developer on its surface by the magnetic attracting force of the permanent magnet 164 disposed therein, and applies the developer to the photosensitive member on the rotating drum 12, thereby causing selective adhesion of the toner to the photosensitive member according to the latent electrostatic image formed on the photosensitive member. The toner supply mechanism 152 includes a toner holding receptacle 168, a hollow cylindrical toner cartridge 170 mounted above one end portion of the toner receptacle 168, a toner conveying means 172 (FIG. 1) disposed within the toner receptacle 168, and a toner supply means 174 (FIG. 1). The toner cartridge 170 has a discharge opening 176 openable at a predetermined angular position on its peripheral side wall as shown in FIG. 1. After opening the discharge opening 176, the toner cartridge 170 is inserted into the toner receptacle 168 through a circular opening formed in the front surface of the toner receptacle 168 while the discharge opening 176 is located upwardly. Then, the toner cartridge 170 is turned in the state shown in FIG. 1 in which its discharge opening 176 is located below. As a result, the toner held in the toner cartridge 170 is discharged downwardly through the discharge opening 176 and supplied to the toner receptacle 168. The toner conveying means 172 which may be of any suitable type located below the discharge opening 176 is driven by a toner supplying motor (not shown) mounted on the rear surface of the toner receptacle 168 to convey the toner discharged from the discharge opening 176 of the toner cartridge 170 to the left in FIG. 1. The toner supplying means 174 which may be of any desired type disposed in the lower portion of the left end of the toner receptacle 168 is rotated by the aforesaid motor (not shown) and supplies the toner conveyed by the toner conveying means 172 to the developer receptacle 154 of the developing mechanism 150 through an opening 178 formed in the left end of the toner receptacle 168. To the left end wall of the toner receptacle 168 is fixed a cover 180 extending to the left therefrom for covering the upper portion of the developing mechanism 150.

The method of mounting the developing device 30 on the drum unit frame 148 will be described with reference mainly to FIG. 5. The developer receptacle 154 is fixed between the front wall 144 and the rear wall 146 of the unit frame 148 by screwing setscrews (not shown) into the front wall 144 and the rear wall 146. The front wall 144, the rear wall 146 and the developer receptacle 154 may be constructed as a one-piece unit. The stirring means 160 of the developing mechanism 150 has shaft supporting members 182 and 184 having a circular peripheral surface and mounted respectively in the front end portion and rear end portion of the stirring means 160. By fitting the shaft supporting members 182 and 184 into holes 186 and 188 formed in the front wall 144 and the rear wall 146 respectively of the drum unit frame 148, the stirring means 160 is rotatably mounted across the front wall 144 and the rear wall 146 of the unit frame 148. Likewise, the magnetic brush means 166 has shaft supporting members 190 and 192 having a circular peripheral surface mounted on its front end portion and rear end portion respectively, and by fitting the supporting members 190 and 192 into holes 194 and 196 formed in the front wall 144 and rear wall 146 of the unit frame 148, the magnetic brush means 166 is rotatably mounted across the front wall 144 and the rear wall 146 of the unit frame 148.

Gears 198 and 200 are fixed respectively to the rear end of the stirring means 160 (rearwardly of the shaft supporting member 184 mounted on the rear end portion) and the rear end of the magnetic brush means 166 (rearwardly of the supporting member 192 mounted on the rear end portion). The gears 198 and 200 are brought into mesh with each other, and one gear 200 is drivingly coupled to a driving source (not shown) such as an electric motor constituting a main driving source for the electrostatic copying apparatus through a suitable power transmission mechanism when the drum unit 142 is mounted in place on the upper supporting frame 112 in the manner to be described. The integrally assembled toner supply mechanism 152 is fixed to the developer receptacle 154 by screwing setscrews 208 and 210 into screw holes 204 and 206 formed in a projecting portion existing in the right end portion of the developer receptacle 154 through holes 202 (FIG. 3 shows only one hole 202 formed in the projecting portion in the front surface) formed in projecting portions existing in the front surface and rear surface of the toner receptacle 168.

The structure of the rotating drum 12 will now be described briefly with reference to FIG. 5. The illustrated rotating drum 12 has a cylindrical sleeve-like drum body 212. A photosensitive member is disposed on the entire circumference of the drum body 212 over its substantially entire width. Boss portions 214 (only one of which is shown in FIG. 5) are formed at the opposite ends of the drum body 212, and bearing members 216 and 218 each having a circular peripheral surface are mounted on the boss portions 214 respectively (see FIG. 7 also). A gear portion 220 is formed on the entire periphery of the rear end portion of the rotating drum 12. The gear portion 220 is drivingly coupled to a driving source (not shown) constituting a main driving source of the electrostatic copying apparatus through a suitable power transmission mechanism when the drum unit 142 has been mounted in position on the upper supporting frame 112.

With reference to FIG. 5, the method of mounting the rotating drum 12 on the drum unit frame 148 will be described. Nearly semicircular receiving portions 226 (FIG. 5 shows only the receiving portion 226 defined in the front surface of the rear wall 146 of the drum unit 148) with an open upper portion are defined in the rear surface of the front wall 144 and the front surface of the rear wall 146 of the drum unit frame 148 by nearly U-shaped receiving members 222 and 224 (see FIG. 7 also). The rotating drum 12 is rotatably mounted in position between the front wall 144 and the rear wall 146 of the drum unit frame 148 when the bearing members 216 and 218 mounted on its both ends are received by the receiving portions 226. On the other hand, restraining pieces (not shown) having a semicircular recess at their lower end are fixed respectively to the rear surface of the vertical front base plate 116 and the front surface of the vertical rear base plate 118 on which the drum unit frame 148 is mounted. When the drum unit 142 is mounted in position on the upper supporting frame 112 in the manner to be described hereinafter, the recesses of these restraining pieces contact the upper half surfaces of the bearing members 216 and 218 mounted on both ends of the rotating drum 12, thereby accurately hampering the upward movement of the bearing members 216 and 218 (and therefore the rotating drum 12) from the receiving portions 226.

Figure 6:
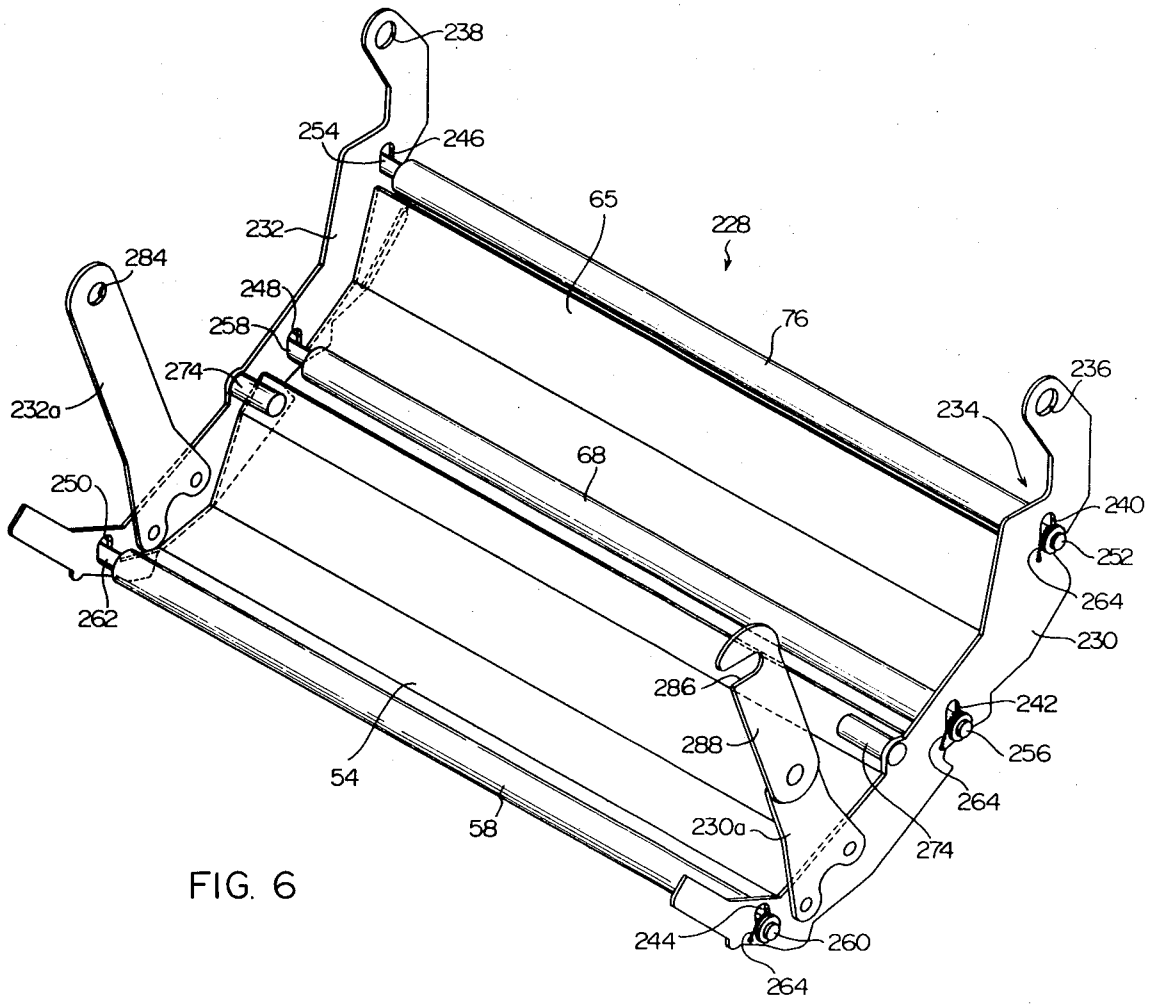
FIG. 6 is a perspective view showing a conveying unit in the electrostatic copying apparatus shown in FIG. 1.

Now, with reference to FIGS. 2 to 4 and 6, mainly FIGS. 4 and 6, the conveying unit of a part of the paper conveying means 38 will be described. The conveying unit generally shown at 228 includes a conveying unit frame 234 having a front wall 230 and a rear wall 232 spaced from each other in the front-rear direction (the direction extending from right bottom toward left top in FIGS. 2 and 6, the direction perpendicular to the sheet surface in FIGS. 3 and 4, and the left-right direction in FIG. 7). Holes 236 and 238 are formed respectively in the right end portions of the front wall 234 and the rear wall 232 of the conveying unit frame 234. The hole 236 formed in the front wall 230 of the conveying unit frame 234 receives the frontwardly projecting end portion of the supporting pin 124 fixed to the vertical front base plate 116 of the lower supporting frame 110 (more specifically, a site further ahead of the mounting site on which the vertical front base plate 128 of the upper supporting frame 112 is mounted), and the hole 238 formed in the rear wall 232 of the conveying unit 234 receives the frontwardly projecting end portion of the supporting pin 126 fixed to the vertical rear base plate 118 of the lower supporting frame 110. As a result, the conveying unit frame 234 is mounted on the supporting frame structure so that it can freely pivot about the central axis of the supporting pins 124 and 126 (the central axis becomes the pivoting axis of the conveying unit frame 234 extending in the front-rear direction) (see FIG. 2 also). A part of the paper conveying means 38 is mounted on the conveying unit frame 234. With reference to FIGS. 4 and 6, slots 240, 242 and 244 spaced from each other in the paper conveying direction are formed in the front wall 230 of the conveying unit frame 234, and slots 246, 248 and 250 spaced from each other in the paper conveying direction are formed in the rear wall 232 of the conveying unit frame 234. The conveying roller 76 has shaft portions 252 and 254 at opposite end portions, and by fitting these shaft portions 252 and 254 into the slots 240 and 246 formed in the front wall 230 and the rear wall 232 respectively of the conveying unit frame 234, the conveying roller 76 is mounted across the front wall 230 and the rear wall 232 of the conveying unit frame 234 rotatably and movably along the slots 240 and 246. The conveying roller 68 has shaft portions 256 and 258 at its opposite end portions, and by fitting the shaft portions 256 and 258 into the slots 242 and 248 formed respectively in the front wall 230 and the rear wall 232 of the conveying units 234, is mounted across the front wall 230 and the rear wall 232 rotatably and movably along the slots 242 and 248. The conveying roller 58 has shaft portions 260 and 262 at its opposite end portions, and by fitting the shaft portions 260 and 262 into the slots 244 and 250 formed in the front wall 230 and the rear wall 232 of the conveying unit frame 234, is mounted across the front wall 230 and the rear wall 232 rotatably and movably along the slots 244 and 250. Each of these conveying rollers 76, 68 and 58 is elastically biased downwardly by the action of a spring member 264 which strides over the upper portion of each of the shaft portions 252, 256 and 260 on one side and of which both end portions are mounted on the front wall 230 of the conveying unit frame 234 and a spring member (not shown) which strides over the upper portion of each of the shaft portions 254, 258, and 262 on the other side and of which both end portions are mounted on the rear wall 232 of the conveying unit frame 234. To, and between, the front wall 230 and the rear wall 232 of the conveying unit 234 are fixed a guide plate 72 (omitted in FIG. 6) upstream in the paper conveying direction of the mounting position of the conveying roller 76, vertically spaced guide plates 64 and 65 between the mounting positions of the conveying rollers 76 and 68, vertically spaced guide plates 52 and 54 between the mounting positions of the conveying rollers 68 and 58, and a guide plate 80 (omitted in FIG. 6) downstream of the mounting position of the conveying roller 58 in the paper conveying direction.

On the other hand, the conveying roller 74 cooperating with the conveying roller 76, the conveying roller 66 cooperating with the conveying roller 68, and the conveying roller 56 cooperating with the conveying roller 58 are rotatably mounted across the vertical front base plate 116 and the vertical rear base plate 118 (FIG. 2) of the lower supporting frame 110. These conveying rollers 56, 66 and 74 are drivingly coupled to the driving source (not shown) constituting the main driving source of the electrostatic copying apparatus through a suitable power transmission mechanism. Furthermore, to, and between, the vertical front base plate 116 and the vertical rear base plate 118 of the lower supporting frame 110 are fixed a guide plate 70 opposite to the guide plate 72, a guide plate 62 opposite to the guide plates 64 and 65, a guide plate 50 opposite to the guide plates 52 and 54, and a guide plate 78 opposite to the guide plate 80. In the illustrated embodiment, the copying paper feed means, i.e. the first paper feed device 40*a*, the second paper feed device 40*b* or the third paper feed device 40*c*, is provided in the lower supporting frame 110.

It will be understood from the foregoing description that in the illustrated electrostatic copying apparatus, in relation to the first paper feed device 40*a*, the guide plates 50, 52 and 54, the conveying rollers 56 and 58 and the guide plates 78 and 80 constitute a first paper conveying mechanism for guiding the copying paper delivered from the first paper feed device 40*a* to the rotating drum 12. The first paper conveying mechanism defines a paper conveying passage between the guide plates 52 and 54, the conveying roller 58 and the guide plate 80 disposed on the upper side (all of which constitute upper elements) and the guide plate 52, the conveying roller 56 and the guide plate 78 disposed on the lower side (all of which constitute lower elements). Furthermore, in relation to the second paper feed device 40*b*, the guide plate 62, the guide plates 64 and 65, the conveying rollers 66 and 68, the guide plates 52 and 50, the guide plate 54, the conveying rollers 56 and 58 and the guide plates 78 and 80 constitute a second paper conveying mechanism for guiding the copying paper delivered from the second paper feed device 40*b* to the rotating drum 12. The second copying paper conveying mechanism defines a paper conveying passage between the guide plates 64 and 65, the conveying roller 68, the guide plate 54, the conveying roller 58 and the guide plate 80 disposed on the upper side (all of which constitute upper elements) and the guide plate 62, the conveying roller 66, the guide plates 52 and 50, the conveying roller 56 and the guide plate 78 disposed on the lower side (all of which constitute lower elements). Moreover, in relation to the third paper feed device 40*c*, the guide plates 70 and 72, the conveying rollers 74 and 76, the guide plates 64 and 62, the guide plate 65, the conveying rollers 66 and 68, the guide plates 52 and 50, the guide plate 54, the conveying rollers 56 and 58 and the guide plates 78 and 80 constitute a third paper conveying mechanism for guiding the copying paper delivered from the third paper feed device 40*c* to the rotating drum 12. The third paper conveying mechanism defines a paper conveying passage between the guide plate 72, the conveying roller 76, the guide plate 65, the conveying roller 68, the guide plate 54, the conveying roller 58 and the guide plate 80 disposed on the upper side (all of which constitute upper elements) and the guide plate 70, the conveying roller 74, the guide plates 64 and 62, the conveying roller 66, the guide plates 52 and 50, the conveying roller 56 and the guide plate 78 disposed on the lower side (all of which constitute lower elements).

The conveying unit frame 234 can freely pivot about the supporting pins 124 and 126 as a center from its operating position shown by solid lines in FIGS. 3 and 4 (when the conveying unit frame 234 is held at this operating position, the conveying rollers 56, 66 and 74 mounted on the lower supporting frame 110 and the conveying rollers 58, 68 and 78 mounted on the conveying unit frame 234 are maintained in press contact with each other, i.e. in a nipping condition) to its open position shown by two-dot chain lines in FIGS. 3 and 4. When the conveying unit frame 234 is held at the open position, all or most of the paper conveying passage defined by the first paper conveying mechanism, the paper conveying passage defined by the second paper conveying mechanism and the paper conveying passage defined by the third paper conveying mechanism are left open.

Now, with reference to FIGS. 2 to 7, the method of mounting the drum unit 142 and the conveying unit 228 in the above embodiment on the upper supporting member 112 will be described. First, with reference to FIGS. 2, 4, 5 and 7, two engaging pins 266 (constituting engaging projections) frontwardly projecting in the front-rear direction and spaced laterally from each other (in the direction extending from left bottom to right top in FIG. 2, the left-right direction in FIG. 4, and the up-and-down direction in FIG. 7) are implanted in the front surface of the vertical front base plate 128 of the upper supporting frame 112, and two laterally spaced engaging openings 268 are formed in the vertical rear base plate 130 of the upper supporting frame 112 (see FIGS. 2 and 7 in particular) in relation to the mounting of the drum unit 142. On the other hand, two laterally spaced engaging openings 270 engageable with the engaging pins 266 implanted in the vertical front base plate 128 are formed in the front wall 144 of the drum unit frame (more specifically, one engaging opening 270 is formed in an upwardly projecting portion 144*a* formed at the upper end of the front wall 144 of the drum unit frame 148, and the other engaging opening 270, in a leftward projecting end portion 144*b* formed at the left end of the front wall 144) (see FIG. 5 in particular). Two laterally spaced engaging pins 272 (constituting engaging projections) projecting rearwardly in the front-rear direction and being engageable with the engaging openings 268 formed in the vertical rear base plate 130 of the upper supporting frame 112 are implanted in the rear surface of the rear wall 146 of the drum unit frame 148 (more specifically, one engaging pin 272 is implanted in the rear surface of an upwardly projecting portion 146*a* formed at the upper end of the rear wall 146 of the drum unit frame 148, and the other engaging pin 272 is implanted in a leftward projecting end portion 146*b* formed at the left end of the rear wall 146) (see FIG. 5 in particular). When the drum unit frame 148 is held at the mounting position (shown by the two-dot chain line in FIG. 7) in the manner to be described, the engaging pins 266 implanted in the vertical front base plate 128 of the upper supporting frame 112 come into engagement with the engaging openings 270 formed in the front wall 144 of the drum unit frame 148, and the engaging openings 268 formed in the vertical rear base plate 130 of the upper supporting frame 112, with the engaging pins 272 implanted in the rear wall 146 of the drum unit frame 148. In the illustrated embodiment, the engaging openings 270 are formed in the front wall 144 of the drum unit frame 148 correspondingly to the engaging pins 266 implanted in the vertical front base plate 128 of the upper supporting frame 112. If desired, it is possible to form the engaging openings in the vertical front base plate 128 and implant the engaging pins in the front wall 144 of the drum unit 148 correspondingly to the engaging openings. Furthermore, in the illustrated embodiment, the engaging pins 272 are implanted in the rear wall 146 of the drum unit frame 148 correspondingly to the engaging openings 268 formed in the vertical rear base plate 130 of the upper supporting frame 112. If desired, however, it is possible to implant the engaging pins in the vertical rear base plate 130 and form the engaging openings in the rear wall 146 of the unit frame 148 correspondingly to the engaging pins.

The lower supporting frame 110 and the conveying unit 228 further have provided therein a provisional unit placing means (see FIG. 2 in particular) for provisionally supporting the drum unit frame 148. The provisional unit placing means in the illustrated embodiment is comprised of four supporting pins 274. The two supporting pins 274 disposed on the right side in the lateral direction are implanted opposite to each other in the rear surface of the front wall 230 of the conveying unit frame 234 and the front surface of the rear wall 232 of the conveying unit frame 234, and the two supporting pins 274 disposed on the left side in the lateral direction are implanted opposite to each other in the rear surface of the vertical front base plate 116 of the lower supporting frame 110 and the front surface of the vertical rear base plate 118 of the lower supporting frame 110. The supporting pins 274 mounted respectively on the front wall 230 of the conveying unit frame 234 and the vertical front base plate 116 of the lower supporting frame 110 project rearwardly in the front-rear direction, and the supporting pins 274 mounted on the rear wall 232 of the conveying unit frame 234 and the vertical rear base plate 118 of the lower supporting frame 110 project frontwardly in the front-rear direction. In the illustrated embodiment, the supporting pins are implanted in the lower supporting frame 110 and the conveying unit frame 234. If desired, however, it is possible to implant the supporting pins only in the lower supporting frame 110 or the conveying unit frame 234.

It will be understood from FIGS. 2 and 5 that in the electrostatic copying apparatus having the provisional unit placing means, the front wall 144 of the drum unit frame 148 is placed on the supporting pins 274 implanted in the vertical front base plate 116 of the lower supporting frame and the front wall 230 of the conveying unit frame 234 (more specifically, a recessed portion 278 formed at the lower edge of the left end portion of the front wall 144 of the drum unit 148 is placed on the supporting pin 274 implanted in the rear surface of the vertical front base plate 116 of the lower supporting frame 110, and a recessed portion 276 formed at the lower edge of the right end portion of the front wall 144 of the drum unit frame, on the supporting pin 274 implanted in the rear surface of the front wall 230 of the conveying unit frame 234). The rear wall 146 of the drum unit frame 148, on the other hand, is placed on the supporting pins 274 implanted in the vertical rear base plate 118 of the lower supporting frame 110 and the front surface of the rear wall 232 of the conveying unit frame 234 (more specifically, a recessed portion 282 formed at the lower edge of the left end portion of the rear wall 146 of the drum unit 148 is placed on the supporting pin 274 implanted in the front surface of the vertical rear base plate 118 of the lower supporting frame 110, and a recessed portion 280 formed at the lower edge of the right end portion of the rear wall 146 of the drum unit frame 148, on the supporting pin 274 implanted in the front surface of the rear wall 232 of the conveying unit frame 234). As can be seen from FIG. 5, when the drum unit frame 148 is placed on the provisional unit placing means, the horizontal edge portions of the recessed portions 276 and 278 formed in the front wall 144 of the drum unit frame 148 abut respectively against the upper ends of the supporting pins 274 implanted in the front wall 230 of the conveying unit frame 234 and the vertical front base plate 116 of the lower supporting frame 110, and at the same time the recessed portions 280 and 282 formed in the rear wall 146 of the drum unit frame 148 abut respectively against the upper ends of the supporting pins 274 implanted in the rear wall 232 of the conveying unit frame 234 and the vertical rear base plate 118 of the lower supporting frame 110. As a result, the drum unit frame 148 is prevented from moving downwardly in the up-and-down direction. Furthermore, the rightward movement in the lateral direction of the drum unit frame 148 is hampered by the abutting of the left vertical edge portion of the recessed portion 276 formed in the right end portion of the front wall 144 against the left end of the supporting pin 274 implanted in the front wall 230 of the conveying unit frame 234 and the abutting of the left vertical edge portion of the recessed portion 280 formed in the right end portion of the rear wall 146 against the left end of the supporting pin 274 implanted in the rear wall 232 of the conveying unit frame 234. Moreover, the leftward movement in the lateral direction of the drum unit frame 148 is hampered by the abutting of the right vertical edge portion of the recessed portion 278 formed in the left end portion of the front wall 144 against the right end of the supporting pin 274 implanted in the vertical front base plate 116 of the lower supporting frame 110 and the abutting of the right vertical edge portion of the recessed portion 282 formed in the left end portion of the rear wall 146 against the right end of the supporting pin 274 implanted in the vertical rear base plate 118 of the lower supporting frame 110. Accordingly, when placed on the provisional placing means, the drum unit frame 148 can move only in the front-rear direction along the supporting pins 274 (as will be described in detail hereinafter, the electrostatic copying apparatus in the illustrated embodiment is constructed such that when the drum unit frame 148 is placed in the provisional unit placing means, the drum unit frame 148 is held at a provisional placing position on the provisional unit placing means shown by a solid line in FIG. 7, and when held at this provisional placing position, the drum unit frame 148 is prevented from moving frontwardly in the aforesaid front-rear direction.)

In the illustrated embodiment, the provisional placing means on which to place the drum unit frame 148 is constructed of the plurality of supporting pins 274. Instead, it is possible to form recesses for provisignal placing in the vertical front base plate 116 of the lower supporting frame 110, and/or the front wall 230 of the conveying unit frame 234 and the vertical rear base plate 118 of the lower supporting frame 110, and/or the rear wall 232 of the conveying unit frame 234, implant pins (to be placed in the recesses) in the front wall 144 and the rear wall 146 of the drum unit frame 148, and constitute the provisional unit placing means from the recesses.

Further, with reference to FIGS. 4, 6 and 7, a projecting arm portion 232*a* is provided in the rear wall 232 of the conveying unit frame 234 in relation to the mounting of the conveying unit frame 234. An engaging opening 284 is formed in the tip portion of the projecting arm portion 232*a*. When the drum unit frame 148 is held at its mounting position in the manner to be described below, the engaging opening 284 formed in the rear wall 232 of the conveying unit frame 234 comes into engagement with one of the engaging pins 272 implanted in the rear surface of the rear wall 146 of the drum unit frame 148 (in the illustrated embodiment, the engaging pin 272 implanted in the upwardly projecting portion 146*a* of the rear wall 146). (At this time, the engaging pin 272 implanted in the rear wall 146 of the drum unit frame 148 also engages the engaging opening 268 formed in the vertical rear base plate 130 of the upper supporting frame 112.) Furthermore, a projecting arm portion 230*a* is formed in the front wall 230 of the conveying unit frame 234, and a restraining means is mounted on the forward end portion of the projecting arm portion 230*a*. The restraining means is formed of a restraining member 288 having a U-shaped recess 286, and is mounted pivotably on the forward end portion of the projecting arm portion 230*a*. The recess 286 of the restraining member 288 comes into engagement with an annular groove 290 (shown by a one-dot chain line in FIG. 7) formed in the projecting portion of one of the engaging pins 266 implanted in the vertical front base plate 128 of the upper supporting frame 112 (the engaging pin disposed on the right side in the illustrated embodiment). This projecting portion projects frontwardly through the engaging opening 270 formed in the upwardly projecting portion 144*a* of the front wall 144 of the drum unit frame 148 when the drum unit frame is held at the mounting position in the manner to be described. When the restraining member 288 is so engaged, the movement in the front-rear direction of the drum unit frame 148 with respect to the upper supporting frame 112 is restained, and the front wall 230 of the conveying unit frame 234 is restrained at a predetermined position with respect to the upper supporting frame 112. In the illustrated embodiment, the engaging pin 272 implanted in the rear wall 146 of the drum unit frame 148 and adapted to engage the engaging opening 268 formed in the vertical rear base plate 130 of the upper supporting frame 112 is brought into engagement with the engaging opening 284 formed in the projecting arm portion 232*a* of the rear wall 232 of the conveying unit frame 234. Instead, it is possible to implant another engaging pin in addition to the engaging pin 272 to be engaged with the engaging opening 268 in the rear wall 146 of the drum unit frame 148, and engage this engaging pin with the engaging opening 284 formed in the rear wall 232 of the conveying unit frame 234. Furthermore, in the illustrated embodiment, the recess 286 of the restraining member 288 is engaged with the groove 290 formed in the engaging pin 266 which is implanted in the front surface of the vertical front base plate 128 of the upper supporting frame 112 and adapted to engage the engaging opening 270 formed in the front wall 144 of the drum unit frame 148. Alternatively, it is possible to implant another engaging pin having a groove in the front surface of the front wall 144 of the drum unit frame 148 or the front surface of the vertical front base plate 128 of the upper supporting frame 112 in addition to the engaging pin 266 engaging the engaging opening 270 formed in the front wall 144 of the drum unit frame 148, and to engage the recess 286 of the restraining member 288 with the groove of this engaging pin (when the engaging pin is implanted in the front surface of the vertical front base plate 128 of the upper supporting frame 112, the forward end portion of the engaging pin is caused to project through the front wall 144 of the drum unit frame 148 and engage the recess 268 of the restraining member 288 with the groove formed in this projecting portion, in the same way as stated above). Furthermore, in the illustrated embodiment, the restraining means is constructed of the single restraining member 288, and the position of the conveying unit frame 234 with respect to the upper supporting frame 112 and the movement in the front-rear direction of the drum unit frame 148 are restrained by the sole restraining member 288. If desired, the restraining means may be constructed of two restraining members, one for restraining the front-rear direction movement of the drum unit frame 148, and the other for restraining the position of the conveying unit frame 234 with respect to the upper supporting frame 112.

In the electrostatic copying apparatus having the aforesaid structure, the drum unit 142 is mounted on, or detached from, the upper supporting frame 112 in the manner to be described, and the conveying unit 228 is restrained at a prdetermined position with respect to the upper supporting frame in the manner to be described below.

With reference mainly to FIGS. 2 to 4 and 7, mounting of the drum unit 148 on the upper supporting frame 112 starts with the pivoting the upper supporting frame 112 with respect to the lower supporting frame 110 to hold it at the open position shown in FIG. 2 (shown by the two-dot chain line) and by the two-dot chain line in FIG. 3. Then, the drum unit frame 148 is placed on the provisional unit placing means, specifically on the supporting pins 274 implanted in the front wall 230 and the rear wall 232 of the conveying unit frame 234 held at the operating position shown in FIG. 2 (FIG. 2 omits the elements mounted on the conveying unit frame 234 and the elements mounted on the lower supporting frame 110) and shown by solid lines in FIGS. 3 and 4, and the supporting pins 274 implanted in the vertical front base plate 116 and the vertical rear base plate 118 of the lower supporting frame 110. (When not restrained by the restraining member 288, the conveying unit frame 234 pivots by its own weight counterclockwise in FIGS. 3 and 4 about the supporting pins 124 and 126 as a center and is held at the aforesaid operating position.)

As can be easily understood from FIG. 7, when the drun unit frame 148 is placed on the provisional unit placing means, a part of the front surface of the front wall 144 of the drum unit frame 148 (more specifically, the right end portion of the front surface of the front wall 144) is guided by the rear surface of the vertical front base plate 116 of the lower supporting frame 110, and one of the engaging pins 272 implanted in the rear wall 146 of the drum unit frame 148 (more specifically, the rear end surface of the engaging pin 272 implanted in the rear surface of the upwardly projecting portion 146*a* of the rear wall 146) is guided by the front surface of the rear wall 232 of the conveying unit frame 234 (more specifically, the front surface of the projecting arm portion 232*a* provided in the rear wall 232). As a result, the drum unit frame 148 is placed on a predetermined provisional placing position in the provisional unit placing means which is shown by the two-dot chain line in FIG. 7. When the drum unit frame 148 is so placed, the recessed portion 276 formed in the right end portion of the front wall 144 of the drum unit frame 148 and the recessed portion 278 formed in the left end portion of the front wall 144 are placed respectively on the supporting pin 274 implanted in the front wall 230 of the conveying unit frame 234 and the vertical front base plate 116 of the lower supporting frame 110. Furthermore, the recess 280 formed in the right end portion of the rear wall 146 of the drum unit frame 148 and the recess 282 formed in the left end portion of the rear wall 146 are placed respectively on the supporting pin 274 implanted in the rear wall 232 of the conveying unit frame 234 and the supporting pin 274 implanted in the vertical rear base plate 118 of the lower supporting frame 110. As a result, the drum unit frame 148 becomes movable only in the front-rear direction along the supporting pins 274 as stated hereinabove. (At this provisionally placed position, a part of the front surface of the front wall 144 of the drum unit frame 148 abuts against the front surface of the vertical front base plate 116 of the lower supporting frame 110, and therefore, the movement in the front direction of the drum unit frame 148 is hampered.) Moreover, when the drum unit frame 148 is so placed, the engaging pin 272 implanted in the upwardly projecting portion 146*a* of the rear wall 146 of the drum unit frame 148 is brought into alignment in the front-rear direction with the engaging opening 284 formed in the projecting arm portion 232*a* of the rear wall 232 of the conveying unit frame 234 (with the engaging opening 284 located slightly rearwardly of the engaging pin 272 in the front-rear direction). (Accordingly, the rearward movement of the drum unit frame 148 in the front-rear direction becomes possible. But when the drum unit frame 148 is moved rearwardly in the front-rear direction in this condition, the engaging pin 272 implanted in the upwardly projecting portion 146*a* of the rear wall 146 abuts against the front surface of the vertical rear base plate 130 of the upper supporting frame 112, and therefore, the rearward movement of the drum unit frame 148 in the front-rear direction is restricted by the vertical rear base plate 130.)

Then, the upper supporting frame 112 is pivoted with respect to the lower supporting frame 110 counterclockwise in FIG. 3 (counterclockwise as viewed from right bottom to left top in FIG. 2) to bring it from the open position to the closed position shown by the solid line in FIG. 3. Consequently, a part of the locking means (not shown) engages the engaging shaft 138 (FIG. 2) mounted across the vertical front base plate 116 and the vertical rear base plate 118 of the lower supporting frame 110, and the upper supporting frame 112 is held at the aforesaid closed position. When the upper supporting frame 112 is held at the closed position, the engaging opening 270 formed in the front wall 144 of the drum unit frame 148 is brought into alignment in the front-rear direction with the engaging pin 266 implanted in the front surface of the vertical front base plate 128 of the upper supporting frame 112, and at the same time, the engaging pin 272 implanted in the rear surface of the rear wall 146 of the drum unit frame 148 is brought into alignment in the front-rear direction with the engaging opening 268 formed in the vertical rear base plate 130 of the upper supporting frame 112, as can be understood from FIGS. 3, 4 and 7.

Subsequently, the drum unit 148 placed on the provisional unit placing means is moved rearwardly in the front-rear direction to bring it to a mounting position shown by the two-dot chain line in FIG. 7 from the aforesaid provisional placing position. When the drum unit frame 148 is held at the mounting position, the rear surface of the upwardly projecting portion 146*a* of the rear wall 146 of the drum unit frame 148 abuts against the front surface of the projecting arm portion 232*a* of the rear wall 232 of the conveying unit frame 236, and at the same time, the rear surfaces of the upper end portions and left end portion of the front wall 144 of the drum unit frame 148 abut against the front surface of the vertical front base plate 128 of the upper supporting frame 112. As a result, the drum unit frame 148 is accurately held at the mounting position. When the drum unit frame 148 is so held at the mounting position, the engaging opening 270 formed in the front wall 144 of the drum unit frame 148 receives the engaging pin 266 implanted in the vertical front base plate 128 of the upper supporting frame 112 (and therefore, the engaging opening 270 and the engaging pin 266 are brought into engagement). Furthermore, the engaging pin 272 implanted in the rear surface of the upwardly projecting portion 146*a* of the rear wall 146 of the drum unit frame 148 is inserted into the engaging opening 284 formed in the projecting arm portion 232*a* of the rear wall 232 of the conveying unit frame 234 and further inserted in one of the engaging openings 268 formed in the vertical rear base plate 130 of the upper supporting frame 112 (thus the engaging pin 272 is kept in engagement with the engaging openings 268 and 284). At the same time, the engaging pin 272 implanted in the rear surface of the leftward projecting end portion 146*b* of the rear wall 146 of the drum unit frame is inserted in the other engaging opening 268 formed in the vertical rear base plate 130 of the upper supporting frame 112 (thus the engaging pin 272 engages the engaging opening 268). As a result, the drum unit frame 148 is mounted on the upper supporting frame 112 and the rear wall 232 of the conveying unit frame 234 is restrained at a predetermined position with respect to the upper supporting frame 112. When the drum unit frame 148 is so held at the mounting position and mounted on the upper supporting frame 112, the gear portion 220 provided in the rotating drum 12 mounted across the front wall 144 and the rear wall 146 of the drum unit frame 148 and the gear 200 fixed to the magnetic brush mechanism 166 mounted across the front wall 144 and the rear wall 146 of the drum unit frame 148 are drivingly coupled respectively to the driving source constituting the main driving source of the electrostatic copying apparatus through a suitable power transmission mechanism.

Then, the restraining member 288 is pivoted to engage its recess 286 with the annular groove 290 formed in the projecting portion of one of the engaging pins 266 implanted in the vertical front base plate 128 of the upper supporting frame 112 (the engaging pin disposed on the right hand side) which projecting portion projects forwardly through the engaging opening 270 formed in the upwardly projecting portion 144*a* of the front wall 144 of the drum unit frame 148, as shown in FIGS. 3 and 4. When this engagement is achieved, the moment tending to pivot the restraining member 288 counterclockwise in FIGS. 3 and 4 about its lower end portion as a center by its own weight acts on the recess 286. Hence, this prevents the restraining member 288 from coming out of engagement with the engaging pin 266. To ensure the prevention of disengagement, a spring member can also be provided. When this engagement is achieved, the movement in the front-rear direction of the drum unit frame 148 with respect to the lower supporting frame 110 is restrained by the restraining member 288, and consequently, the drum unit frame 148 is accurately mounted on the upper supporting frame 112. Furthermore, when this engagement is achieved, the front wall 230 of the conveying unit frame 234 is also restrained at a predetermined position with respect to the upper supporting frame 112, and thus, the conveying unit frame 234 is accurately restrained at a predetermined position with respect to the upper supporting frame 112 as shown in FIGS. 3 and 4.

When the drum unit frame 148 has been mounted on the upper supporting frame 112 and the conveying unit frame 234 has been restrained at a predetermined position with respect to the upper supporting frame 112, the drum unit frame 148 and the conveying unit frame 234 are mounted on the upper supporting frame 112 so that they move as a unit with the upper supporting frame 112, as can be seen from FIGS. 3 and 4. When the drum unit frame 148 and the conveying unit frame 234 are mounted on the upper supporting frame 112 as above and then the upper supporting frame 112 is held at the open position (shown in FIG. 2 and by the two-dot chain line in FIG. 3), the drum unit frame 148 and the conveying unit frame 234 are also pivoted as a unit with the upper supporting frame 112. As a result, the drum unit frame 148 is held at the position shown in FIGS. 3 and 4, and the conveying unit frame 234, at its open position shown by two-dot chain lines in FIGS. 3 and 4. When the conveying unit frame 234 is held at the open position, the conveying passage is opened between the guide plates 70 and 72, between the conveying rollers 74 and 76, between the guide plate 62 and the guide plates 64 and 65, between the conveying rollers 66 and 68, between the guide plate 50 and the guide plates 52 and 54, between the conveying rollers 56 and 58, and between the guide plates 78 and 80. Specifically, in relation to the first paper conveying mechanism for conducting the paper delivered from the first paper feed device 40*a* to the rotating drum 12, the conveying passage is open between the guide plate 50 and the guide plates 52 and 54, between the conveying rollers 56 and 58, and the guide plates 78 and 80, and thus the paper conveying passage ranging from the first paper feed device 40*a* to the rotating drum 12 is opened. Furthermore, in relation to the second paper conveying mechanism for conducting the copying paper delivered from the second paper feed device 40*b* to the rotating drum 12, the conveying passage is open between the guide plate 62 and the guide plates 64 and 65, between the conveying rollers 66 and 68, between the guide plates 50 and 54, between the conveying rollers 56 and 58 and between the guide plates 78 and 80, and thus the paper conveying passage ranging from the second paper feed device 40*b* to the rotating drum 12 excepting the space between the guide plates 52 and 54 is opened. Furthermore, in relation to the third paper conveying mechanism for conducting the copying paper delivered from the third paper feed device 40*c* to the rotating drum 12, the conveying passage is open between the guide plates 70 and 72, between the conveying rollers 74 and 76, between the guide plates 62 and 65, between the conveying rollers 66 and 68, between the guide plates 50 and 54, between the conveying rollers 56 and 58, and between the guide plates 78 and 80, and thus the paper conveying passage ranging from the third paper feed device 40*c* to the rotating drum 12 excepting the space between the guide plates 64 and 65 and the space between the guide plates 52 and 54 is opened. Thus, by holding the conveying unit frame 234 at the open position in the manner stated above, all or most of the paper conveying passages ranging from the paper feed means (the first paper feed device 40*a*, the second paper feed device 40*b* and the third paper feed device 40*c*) to the rotating drum 12 can be opened. In particular, as can be seen from the foregoing description, the nipping conditions of the conveying roller pairs 56 and 58, 66 and 68, and 74 and 76 can all be cancelled. Accordingly, if the copying paper should jam up in the paper conveying passage, it can be removed very easily.

To detach the drum unit frame 148 from the upper supporting frame 112, the following procedure is taken. First, the restraining member 288 is pivoted clockwise in FIGS. 3 and 4 to disengage the recess 286 of the restraining member 288 from the groove 290 formed in one of the engaging pins 266 implanted in the vertical front base plate 128 of the upper supporting frame 112. Then, the drum unit 148 is moved frontwardly in the front-rear direction to bring it to the aforesaid provisional placing position from the mounting position (when the drum unit frame 148 is held at the provisional placing position, the right end portion of the front surface of the front wall 144 of the drum unit frame 148 abuts against the rear surface of the vertical front base plate 116 of the lower supporting member 110). Furthermore, the engagement between the locking means (not shown) and the engaging shaft 138 is cancelled, and the upper supporting frame 112 is pivoted clockwise in FIG. 3 and held at the open position shown in FIG. 2 and by the two-dot chain line in FIG. 3. Thereafter, the drum unit frame 148 held at the provisional placing position on the provisional unit placing means is lifted off the provisional unit placing means.

While the shell-type electrostatic copying apparatus constructed in accordance with this invention has been described in detail with reference to the preferred embodiments, it should be understood that the invention is not limited to these specific embodiments, and various changes and modifications are possible without departing from the scope of the invention.

For example, in the illustrated embodiments, the paper feed devices are of the cassette type. As required, either one of the cassette-type paper feed devices may be built in a manual feeding type.

Furthermore, in the illustrated embodiments three paper feed devices are used. But the invention can also be applied to electrostatic copying apparatuses which include 1, 2 or 4 or more paper feed devices.

What is claimed is:

1. A shell-type electrostatic copying apparatus comprising a supporting structure consisting of a lower supporting frame and an upper supporting frame mounted on the lower supporting frame for free pivotal movement between an open position and a closed position about a pivoting axis extending in the front-rear direction as a center, a rotating drum mounted rotatably on the supporting structure, at least one copying paper feed device mounted on the supporting structure, and a copying paper conveying mechanism for conducting a copying paper delivered from the paper feed device to the rotating drum, said conveying mechanism including a plurality of lower elements and a plurality of upper elements with a copying paper conveying passage being defined between the lower elements and the upper elements; wherein at least one of the lower elements of the paper conveying mechanism is mounted on the lower supporting frame, a conveying unit frame is mounted on the supporting structure for free pivotal movement about a pivoting axis extending in the front-rear direction, a restraining means is provided for releasably restraining the conveying unit frame at a predetermined position with respect to the upper supporting frame, and at least one of the upper elements of the conveying mechanism is mounted on the conveying unit frame.

2. The apparatus of claim 1 wherein the axis of pivoting of the upper supporting frame with respect to the lower supporting frame is in alignment with the axis of pivoting of the conveying unit frame with respect to the upper supporting frame.

3. The apparatus of claim 1 wherein the lower elements of the paper conveying mechanism include at least one lower conveying roller and at least one lower guide plate and the upper elements of the paper conveying mechanism includes at least one upper conveying roller cooperating with the lower conveying roller and at least one upper guide plate located opposite to the lower guide plate, and wherein at least the lower conveying roller is mounted on the lower supporting frame and at least the upper conveying roller is mounted on the conveying unit frame.

4. The apparatus of claim 1 wherein the paper feed device is mounted on the lower supporting frame.

5. The apparatus of claim 1 wherein a drum unit frame is detachably mounted on the upper supporting frame, and the rotating drum is rotatably mounted on the drum unit frame.

6. The apparatus of claim 5 wherein the drum unit frame also has a developing device mounted thereon.

7. A shell-type electrostatic copying apparatus comprising a supporting structure consisting of a lower supporting frame and an upper supporting frame having a vertical front base plate and a vertical rear base plate spaced from each other in the front-rear direction, said upper supporting frame being mounted on the lower supporting frame for free pivotal movement between an open position and a closed position about a pivoting axis extending in the front-rear direction, a drum unit adapted to be detachably mounted on the upper supporting frame, said drum unit including a drum unit frame having a front wall and a rear wall spaced from each other in the front-rear direction and a rotating drum rotatably mounted on the drum unit frame, at least one copying paper feed device mounted on the supporting structure and a copying paper conveying mechanism for conducting a copying paper delivered from the paper feed device to the rotating drum, said conveying mechanism including a plurality of lower elements and a plurality of upper elements with a copying paper conveying passage being defined between the lower elements and the upper elements; wherein at least one of the lower elements of the paper conveying mechanism is mounted on the lower supporting frame;

a conveying unit frame is mounted on the supporting structure for free pivotal movement about a pivoting axis extending in the front-rear direction;

at least one of the upper elements of the paper conveying mechanism is mounted on the conveying unit frame;

a provisional unit placing means for supporting the drum unit frame of the drum unit movably over a predetermined range in the front-rear direction is provided in the lower supporting frame and/or the conveying unit frame;

at least two laterally spaced engaging openings are formed in one of the front wall of the drum unit frame and the vertical front base plate of the upper supporting frame and at least two laterally spaced engaging projections are formed in the other, and at least two laterally spaced engaging projections are formed in one of the rear wall of the drum unit frame and the vertical rear base plate of the upper supporting frame and at least two laterally spaced engaging openings are formed in the other;

a restraining means is provided for releasably restraining the movement of the drum unit with respect to the upper supporting frame in the front-rear direction and also releasably restraining the conveying unit frame at a predetermined position with respect to the upper supporting frame; and when the conveying unit frame is set at an operating position at which at least one of the upper elements mounted thereon is in a predetermined operative relation to at least one of the lower elements mounted on the lower supporting frame, then the drum unit frame is provisionally placed at a predetermined position on the provisional placing means, and thereafter the upper supporting frame is pivoted from the open position to the closed position, the engaging openings formed in one of the front wall of the drum unit frame and the vertical front base plate of the upper supporting frame are brought into alignment in the front-rear direction with the engaging projections formed in the other and at the same time, the engaging projections formed in one of the rear wall of the drum unit frame and the vertical rear base plate of the upper supporting frame are brought into alignment in the front-rear direction with the engaging openings formed in the other; thereafter, when the drum unit frame is set at a mounting position by moving it rearwardly or frontwardly from the provisional placing position, the engaging openings formed in one of the front wall of the drum unit frame and the vertical front base plate of the upper supporting frame engage the engaging projections formed in the other and at the same time, the engaging projections formed in one of the rear wall of the drum unit frame and the vertical rear base plate of the upper supporting frame engage the engaging openings formed in the other; and thereafter, when the movement in the front-rear direction of the drum unit frame with respect to the upper supporting frame is releasably restrained by the restraining means and the conveying unit frame is releasably restrained by the restraining means at the predetermined position with respect to the upper supporting frame, the drum unit and the conveying unit frame are mounted on the upper supporting frame so that they move as a unit with the upper supporting frame.

8. The apparatus of claim 7 wherein the axis of pivoting of the upper supporting frame with respect to the lower supporting frame is in alignment with the axis of pivoting of the conveying unit frame with respect to the upper supporting frame.

9. The apparatus of claim 7, wherein the lower elements of the paper conveying mechanism include at least one lower conveying roller and at least one lower guide plate and the upper elements of the paper conveying mechanism include at least one upper conveying roller cooperating with the lower conveying roller and at least one upper guide plate located opposite to the lower guide plate, and wherein at least the lower conveying roller is mounted on the lower supporting frame and at least the upper conveying roller is mounted on the conveying unit frame.

10. The apparatus of claim 7 wherein the copying paper feed device is mounted on the lower supporting frame.

11. The apparatus of claim 7 wherein the drum unit includes a developing device mounted on the drum unit frame.

12. The apparatus of claim 7 wherein the lower supporting frame has a vertical front base plate and a vertical rear base plate spaced from each other in the front-rear direction.

13. The apparatus of claim 12 wherein the conveying unit frame has a front wall and a rear wall spaced from each other in the front-rear direction.

14. The apparatus of claim 13 wherein the provisional placing means is comprised of supporting pins implanted opposite to each other in the rear surface of the vertical front base plate of the lower supporting frame and the front surface of the vertical rear base plate of the lower supporting frame and supporting pins implanted opposite to each other in the rear surface of the front wall of the conveying unit frame and the front surface of the rear wall of the conveying unit frame, and the front wall and the rear wall of the drum unit frame are adapted to be placed on the supporting pins.

15. The apparatus of claim 14 wherein said at least two engaging openings are formed in the front wall of the drum unit frame and said at least two engaging projections are formed in the front surface of the vertical front base plate of the upper supporting frame; said at least two engaging projections are formed in the rear surface of the rear wall of the drum unit frame and said at least two engaging openings are formed in the vertical rear base plate of the upper supporting frame; and the drum unit frame is held at the mounting position by moving it rearwardly from the provisional placing position.

16. The apparatus of claim 15 wherein when the drum unit is to be placed on the provisional placing means, at least a part of the front surface of the front wall of the drum unit frame is guided by the rear surface of the vertical front base plate of the lower supporting frame and/or the rear surface of the front wall of the conveying unit frame, and at the same time, at least one engaging projection formed in the rear surface of the rear wall of the drum unit frame is guided by the front surface of the rear wall of the conveying unit frame and/or the front surface of the vertical rear base plate of the lower supporting frame, and as a result, the position of the drum unit in the front-rear direction is regulated.

17. The apparatus of claim 15 wherein the rear wall of the conveying unit frame has a portion having formed therein an engaging opening which when the drum unit has been placed on the provisional placing position, comes into alignment with at least one of said engaging projections formed on the rear surface of the rear wall of the drum unit frame and is positioned rearwardly thereof, and wherein when the drum unit is moved to the mounting position from the provisional placing position, said at least one engaging projection formed in the rear surface of the rear wall of the drum unit frame comes into engagement with both the engaging opening formed in the vertical rear base plate of the upper supporting frame and the engaging opening formed in the rear wall of the conveying unit frame.

18. The apparatus of claim 15 wherein a groove is formed in the projecting portion of at least one of said engaging projections formed in the front surface of the vertical front base plate of the lower supporting plate which projecting portion extends through the engaging opening formed in the front wall of the drum unit and projects frontwardly beyond it when the drum unit is moved from the mounting position from the provisional placing position; and the restraining means is constructed of a restraining member adapted to be movably mounted on the front wall of the conveying unit frame and engage said groove releasably.

* * * * *